US006394149B1

(12) United States Patent
Parsons

(10) Patent No.: US 6,394,149 B1
(45) Date of Patent: May 28, 2002

(54) VAPOR CONTROL

(75) Inventor: Neal D. Parsons, Findlay, OH (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

(21) Appl. No.: 09/798,224

(22) Filed: Mar. 2, 2001

(51) Int. Cl.[7] ..... B65B 1/04
(52) U.S. Cl. ..... 141/59; 141/83; 141/289
(58) Field of Search ..... 141/59, 83, 94, 141/290, 289, 301, 302, 307, 325, 192

(56) References Cited

U.S. PATENT DOCUMENTS 4,320,788 A * 3/1982 Lord ..... 137/255
6,082,415 A * 7/2000 Rowland et al. ..... 141/44
6,223,789 B1 * 5/2001 Koch ..... 141/285
6,336,479 B1 * 1/2002 Nanaji ..... 141/302

* cited by examiner

*Primary Examiner*—Steven O. Douglas
(74) *Attorney, Agent, or Firm*—Richard D. Stone; Albert J. Adamcik

(57) ABSTRACT

A method, apparatus, and system for loading organic chemical liquids in a transporting vessel are described. The invention provides for selective transfer of vapor released during loading to a vapor control system or to vent. A vapor control logic system which controls flow direction of vapor captured from a transporting vessel being loaded, either to a vapor control system, or to vent in the environment, is described.

24 Claims, 3 Drawing Sheets

VAPOR CONTROL

BACKGROUND OF THE INVENTION

When many organic chemical liquid compositions, such as hydrocarbon fuels or similar materials, are loaded from a loading facility or system into the tanks or holds of shipping vessels, significant quantities of volatile organic compounds may be released. The vapor released may not only be environmentally polluting but, in sufficient amounts, may present a dangerous fire or explosion hazard. To overcome these concerns, elaborate vapor control schemes and systems have been incorporated over the years into loading operations and systems for capturing the vapor released during loading.

In many instances, the vapor control systems were designed or sized to handle volumes of released vapor based on expected volumes of the fuels, etc., to be loaded, the expected volumes being, in turn, based on best estimates of future demand. However, a combination of unexpected increased consumer demand and increasingly stringent governmental environmental regulations are causing many existing vapor control systems to run near capacity.

With demand for these materials expected to increase to even greater levels, it is evident that existing vapor control systems will be unable to process the volumes of volatile component(s) at a regulatorily required level. While new systems may be installed, or existing vapor control systems may be expanded, significant capital costs are involved. In addition, until the new or expanded systems are operational, loading operations will be restricted by the limited capacity of the current systems. Accordingly, there has been a need for an approach for handling increased loading volumes which avoids the costs and limitations mentioned. The invention addresses this need, and, in a preferred aspect, is directed to loading operations, apparatus, and systems for loading organic chemical liquids, particularly various grades of gasoline, diesel and other distillates, and compositions referred to generally as petroleum hydrocarbons.

SUMMARY OF THE INVENTION

The invention proceeds from an evaluation of the operations of the loading terminal or system, including the spectrum of liquid compositions to be loaded, and from the discovery that circumstances may allow, during loading of some liquid compositions in a vessel, non-use or bypass of the vapor control system or unit. More particularly, some organic chemical liquids to be loaded are of such limited volatility that release or venting of the very minor quantities of vapors released from the vessel during loading will be minimally or essentially non-polluting and the loading operation will therefore remain in compliance with governmental environmental regulations. As employed herein, the expression "liquid of limited volatility" refers to an organic chemical liquid, including mixtures thereof, having such limited vapor pressure that its handling in the environment, such as in a loading operation, does not generate a quantity of vapor or vapors sufficient to exceed governmental environmental regulations or standards. In normal loading operations, such as at a refinery or chemical plant, the vapor pressure of an organic chemical liquid to be loaded will either be known, or may be determined by routine testing, so that a comparison of the particular liquid's true vapor pressure at standard conditions with published governmental environmental limits, which may vary from time to time, may readily be made and the liquid's suitability for venting of vapor determined. At the present time, an organic chemical liquid having a true vapor of below 1.5 psia at 60° F. would meet such governmental requirements.

Broadly, therefore, the invention relates to a novel procedure, apparatus, and system for loading organic chemical liquids in a transporting vessel. In addition, a vapor control logic system is provided which controls flow direction of vapor captured from a transporting vessel being loaded, either to a vapor control system or to vent in response to user input or inputs. Accordingly, in one aspect of the invention, there is input into an input or input means of the logic system mentioned the nature of the organic chemical liquid to be loaded and, if the liquid is a liquid of limited volatility, a further user determination input of whether or not the previous load in the vessel was a liquid of limited volatility. A processor, coupled to said user input or inputs, and responsive thereto, being configured to process one or both of said input determinations, outputs directions for control or disposition of vapor captured or collected while loading the vessel, as described more fully hereinafter.

Alternatively, the vapor control logic system may be designed to input first the user determination of whether or not the previous load in the vessel was a liquid of limited volatility, and, if the previous load was a liquid of limited volatility, a user determination input of the nature of the organic chemical liquid to be loaded in the vessel. In a similar manner, the processor, coupled to said user input or inputs and responsive thereto, and appropriately configured to process one or both of said input determinations, outputs directions for control of vapor captured, as also described more fully hereinafter.

In both cases, the processor, which will be a computer, will be programmed or configured to output directions, as follows. If a load to be loaded is a volatile organic chemical liquid, or if the previous load of the vessel was not a liquid of limited volatility, the flow of captured vapor will be directed to the vapor control system or unit. If the load to be loaded is a liquid of limited volatility, but the previous load was not, the captured vapor will be sent to the vapor control system. However, if the load to be loaded is a liquid of limited volatility, and the previous load of the vehicle was a liquid of limited volatility, the flow of captured vapor(s) will be diverted from the vapor control system and directed to means for venting to atmosphere. If it is not known or ascertainable if the previous load of the vehicle was a liquid of limited volatility, the flow of captured vapors is directed to the vapor control unit. As a failsafe in either case mentioned, the system may further provide optional means for analyzing the captured vapors, as described hereinafter, for preventing an inappropriate atmospheric release.

In a preferred embodiment of the invention, there is input into the logic system the nature of the organic chemical liquid to be loaded and, if a distillate, whether or not the load previously carried by the vessel was a distillate composition. As utilized herein, the expressions "distillate" and "distillate composition", or plural variants thereof, are understood to refer to liquid of limited volatility which is refined from petroleum, and comprising refined hydrocarbon mixtures having a true vapor pressure of below 1.5 psia at 60° F. As will be understood by those skilled in the art, some compounds or components present in such hydrocarbon mixtures are not composed solely of carbon and hydrogen, but may contain other elements, such as nitrogen, oxygen, and sulfur. Common distillates include diesel, oils, such as #1 and #2 fuel oils, kerosene, home heating fuel oil, high sulfur fuel oil, and similar liquids.

In this preferred embodiment, the processor processes the input, and controls the flow of captured or vapor or vapors, as described. If the load to be loaded is not a distillate, e.g., is gasoline, or if the previous load of the vehicle was not a distillate, the flow of captured vapor will be directed to the vapor control unit. If the load to be loaded is a distillate and the previous load of the vehicle was a distillate, the very minimal flow of captured or collected vapor will be diverted from the vapor control system and directed for venting to atmosphere. If it is not known or ascertainable if the previous load of the vehicle was a distillate, the flow of released vapors is directed to the vapor control unit. As already mentioned, as a failsafe, the system may provide optional means for analyzing the captured vapors, as described hereinafter, for preventing inappropriate atmospheric release.

The invention further includes a logic system for controlling vapor released and captured while loading a vessel. The system comprises a) a user input or input means for receiving a user determination input of the nature of an organic chemical liquid to be loaded in a vessel, and, if the liquid to be loaded is of limited volatility, a user determination input of whether or not the previous load in the vessel was a liquid of limited volatility; and b) a processor, coupled to said user input and responsive thereto, being configured to process one or both of said input determinations and output directions for control or disposition of vapor captured or collected during loading. As will be understood, the user input or input means may alternately comprise an input for receiving a user determination input of whether or not the previous load in the vessel was a liquid of limited volatility, and, if the previous load was a liquid of limited volatility, a user determination input of the nature of an organic chemical liquid to be loaded in a vessel.

The invention further comprises apparatus for controlling vapors released while loading a vessel which includes the vapor control logic system embodiments described, and further includes means for capturing vapors released during loading, and means coupled to and controlled by the processor for directing the captured vapors to a vapor control system or to vent.

In a most preferred aspect, the invention comprises a method of loading of a vessel from a loading system including a vapor control system comprising providing a vapor control logic system which controls flow direction of vapor captured from a transporting vessel being loaded to a vapor control system or to vent; inputting into the logic system the nature of the organic chemical liquid to be loaded and, if a distillate, whether or not the load previously carried by the vessel was a distillate composition; processing the inputs in the vapor control logic system; loading the vessel and capturing vapor released from the vessel during loading; and controlling the flow of the captured vapor in response to the inputs to the logic system, either to the vapor control system or to vent. As suggested previously, the inputs will be processed by the processor in the following manner. If an input to the logic system is that liquid to be loaded is a volatile organic chemical liquid, e.g., gasoline, the flow of captured or collected vapors is directed to the vapor control system. If an input to the logic system is that the previous liquid loaded in the vessel was not a distillate, the flow of captured vapors is also directed to the vapor control system. If the inputs to the logic system are that the load to be delivered is a distillate, but the previous liquid loaded in the vessel was not a distillate, the flow of captured vapors is directed to the vapor control system. However, if the inputs to the logic system are that the load to be delivered is a distillate, and the previous load of the vessel was a distillate, the flow of captured vapors may be diverted from the vapor control system and vented to atmosphere. This aspect of the invention also permits the alternative first user determination input of whether or not the previous load in the vessel was a liquid of limited volatility.

In yet a further embodiment, the invention relates to a loading terminal for selective recovery of volatile organic compositions released during the loading of a transporting vessel from a loading system including a vapor control system. The terminal includes means for loading a vessel, and a vapor control system for processing vapors released during loading. According to the invention, means are further provided for capture and selective transfer of vapor released during loading to the vapor control unit or to vent, the means for capture and transfer including programmed computer processing means, for controlling flow of captured vapor, in response to user determined input or inputs. Preferably, the logic control system mentioned may be provided, with access by a user by appropriate means, and means for input or inputs of information to be processed. The terminal provides means for processing the inputs, with outputs for control of captured vapor, by appropriate means, to the vapor control system or to means for vent.

Figure 2:
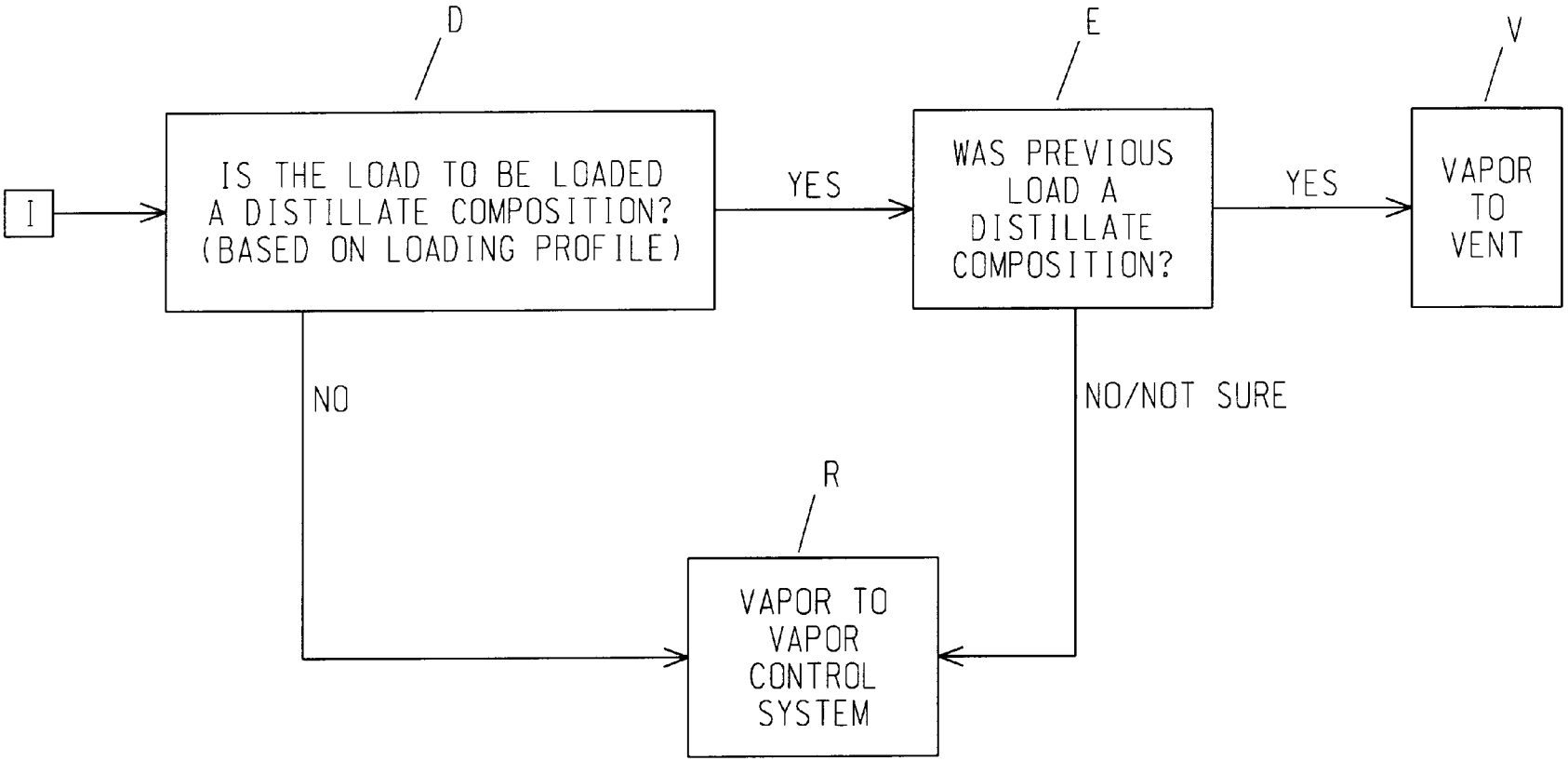
FIG. 2 is a block or flow chart representation illustrating an example of operation of one embodiment of the logic control system of the invention.
Figure 2A:
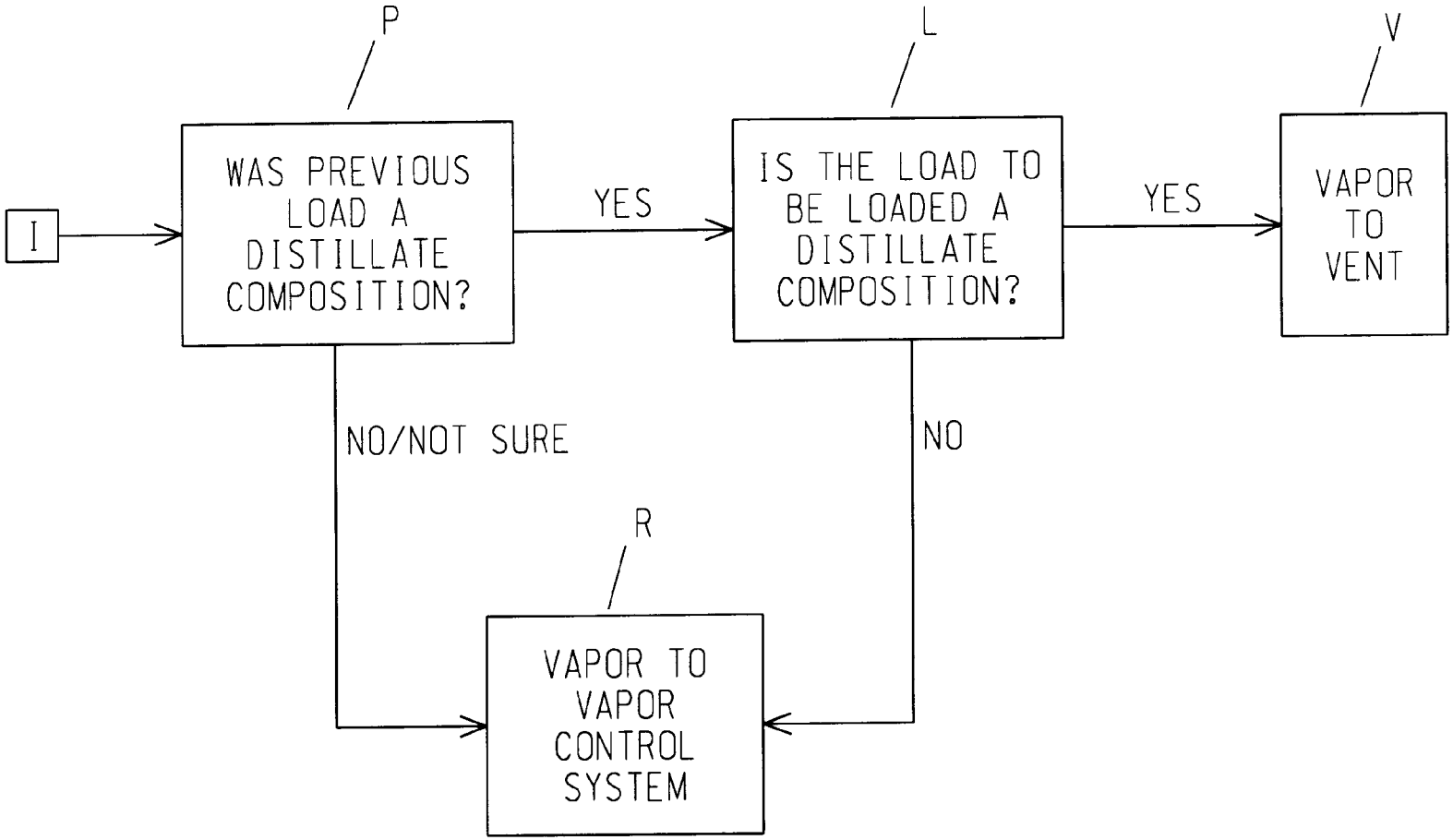

FIG. 2*a* is a block or flow chart representation illustrating an example of operation of a alternative embodiment of the logic control system of the invention.

DETAILED DESCRIPTION

As indicated, the invention is useful in reducing the duty of vapor control systems or units by allowing bypass or non-control of the minimally released vapors from a liquid of limited volatility, and the invention has general applicability to loading operations having vapor control systems or units where both volatile organic chemical liquids and liquid of limited volatility are loaded. As also indicated, a liquid of limited volatility is considered herein as having defined characteristics in terms of vapor pressure. Conversely, a volatile organic chemical liquid or "highly" volatile liquid is to considered to be, in the context of the invention, an organic chemical liquid having a greater vapor pressure than the liquid of limited volatility, i.e., having a vapor pressure greater than that which is regulatorily acceptable.

Additionally, as employed herein, the expressions "organic chemical liquid" and "organic chemical liquids" are taken to refer broadly or generally to a liquid or liquids, respectively, of compounds (and mixtures thereof) based on carbon, principally having chains or rings and also containing hydrogen, with or without oxygen, nitrogen, or other elements. Accordingly, the invention is seen to have wide applicability in the loading of materials handled as refinery or chemical plant products, or other operations or sources. Thus, while a preferred embodiment of the invention is the loading of refined products, such as gasoline range materials and distillates, the handling procedure of the invention is equally applicable in the serial loading, for example, of a distillate, such as fuel oil, and a particular hydrocarbon, such as benzene, ethanol, or even methanol.

For illustration, however, in the following description of a loading terminal operation exemplifying aspects of the invention, a distillate composition, such as a fuel oil, is taken as exemplary of a liquid of limited volatility, while gasoline is an example of a volatile organic chemical liquid.

Figure 1:
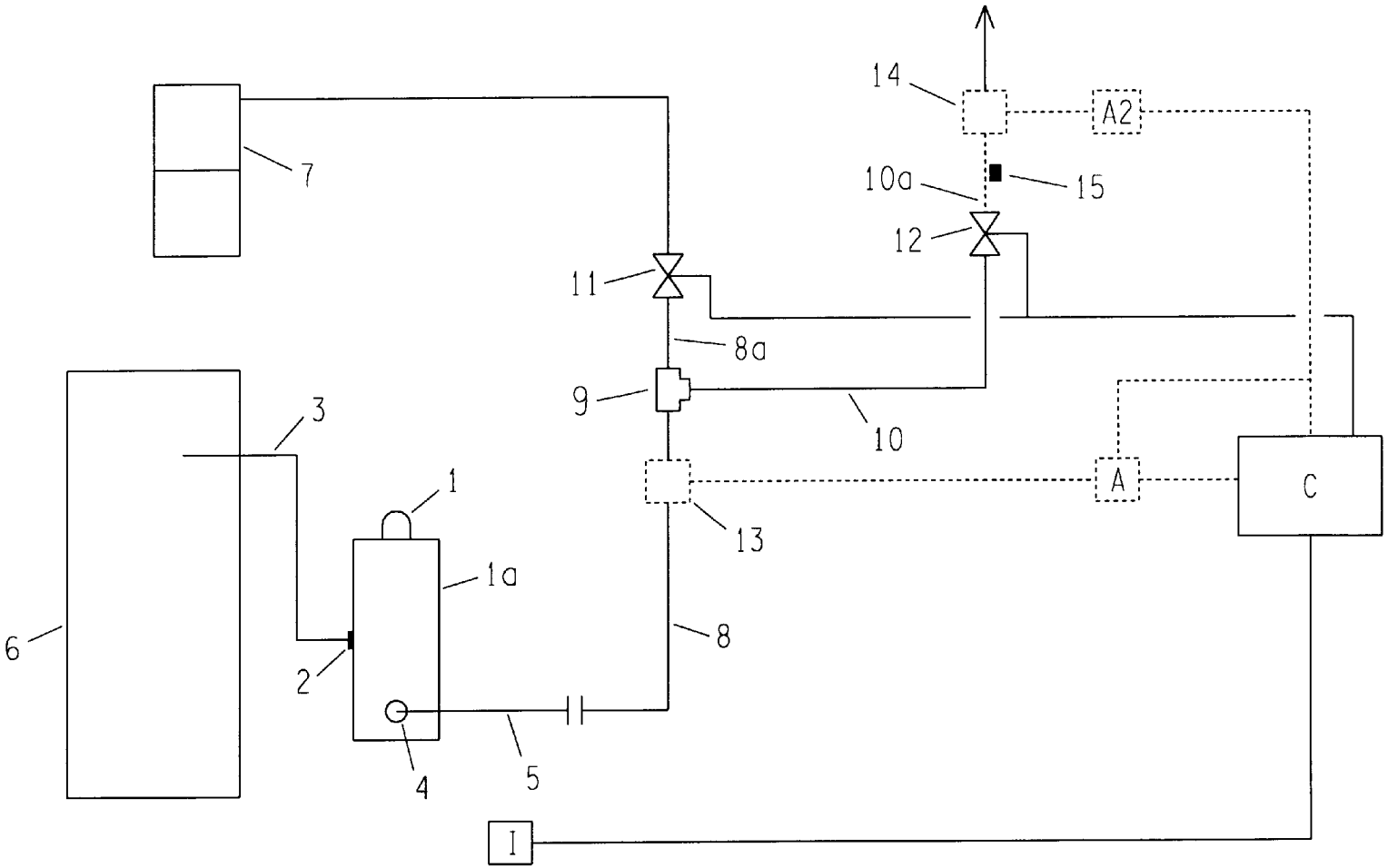
FIG. 1 is a schematic illustration of an example of a selective vapor control system according to the invention.

Accordingly, with reference to FIG. 1, there is illustrated a loading terminal or system designated generally as "T", in which a vessel, in this case tank truck (1), is to be loaded with a fuel oil. Tank truck (1) comprises a fuel transportation tank (1*a*) (or tanks) having one or more inlets (2) being adapted by suitable means, not shown, such as flanges, for connection with a loading hose or hoses (3). As will be understood by those skilled in the art, the vessel to be loaded may be any other suitable transport vessel, such as a railroad car or marine vessel, and the term "vessel" is also understood to include a compartment in a multi-compartmented arrangement.

Vapor outlet (4), also adapted for connection with a vapor recovery hose or line (5), is provided for capture or collection and transfer of any vapor(s) released during loading. Loading hose(s) (3) are supplied from a conventional loading rack (6). Loading operations from rack (6) conventionally require the use of a vapor control system or unit, indicated in FIG. 1 by numeral (7). Conventionally, and not illustrated, vapor recovery or capture hose (5) communicates with the vapor control system (7), to the effect that vapors from vessel (1) are transferred into the system (7) and processed. The vapor control system or unit may be of any suitable type, such as a conventional vapor recovery unit, e.g. comprising one or more carbon bed adsorption units or a refrigeration unit, or, in the appropriate case, may comprise a combustor. Details of the vessel, loading arrangement or means, and the vapor control system per se form no part of the invention, such description as provided herein being only that necessary for understanding of the invention, it being intended accordingly that the description of these elements be construed broadly and including all appropriate equivalents.

According to the invention, means are provided during loading for selectively transferring vapor captured or collected to vapor control system (7), or to vent, under appropriate circumstances. While a wide variety of equivalent means may accomplish the transfer, the following approach is provided for its simplicity and reduced cost. Accordingly, instead of communicating directly with vapor control system (7), hose or line (5) is suitably connected to and communicates with a conduit or pipe (8), which in turn communicates, by suitable means, such as a T-connection (9) or three-way valve, to line (8*a*) and line (10). Line (8*a*) and line (10) contain valves (11) and (12), respectively. Valves (11) and (12) may be of any suitable type, and activated in any suitable manner, but are preferably motor activated. From valve (11), line 8*a* is connected to vapor control system (7), while valve (12) communicates with line or conduit (10*a*), which may comprise a simple vent pipe. Valves (11) and (12) are operationally connected to, and the opening and closing of each is controlled or directed by, a controller indicated as (C). Processor or controller (C) comprises a computer or processor suitably programmed according to the invention, and may comprise a specifically dedicated unit, a larger system directing terminal loading operations, optionally directing the vapor control unit or system, or a may be a portion of a larger server system. Processor (C) is programmed to receive, respond, and process user input from one or more suitable input or access means (I), or other means, according to the vapor logic method of the invention, as exemplified in FIGS. 2 and 2*a*, and to control or direct the released and captured vapor handling, as described more fully hereinafter. In most instances, the "user" providing input to processor (C) will be a vessel operator, although others may do so, as described hereinafter. In addition, line (8) optionally contains a sensor (13) which senses the composition of vapor in line (8) and transfers the sensed information to a vapor analyzer (A), which in turn relays the vapor composition to controller (C). Line (10*a*) optionally contains a sensor (14) which senses the composition of vapor in line (10*a*) and transfers the sensed information to vapor analyzer (A2), or preferably, directly to vapor analyzer A, which in turn relays the vapor composition to processor (C). Processor (C)'s program may be adapted to utilize inputs from analyzer A and/or analyzer A2 to monitor vapor composition in line 8 and line 10*a* for proper routing of vapor and override, if necessary, input from (I) and transfer vapor in line (8) to the vapor control system. The particular type of line composition sensor chosen, such as an infrared or Raman unit, forms no part of the invention, the selection thereof being a matter of choice within the ambit of those skilled in the art. A vapor (15) may be provided in line (10*a*).

The loading operation may be accomplished suitably according to the logic exemplified in FIGS. 2 and 2*a*. In the sequence shown in FIG. 2, there is entered a user determined input into input or controller access (I), which may comprise any suitable input means, such as a data entry terminal, for a rack or terminal operator, or, in the case of a vessel operator, a punch entry or a touch sensitive screen on a data entry terminal. By any such means or equivalent means, and with suitable coupling to controller (C), there is thus input into the logic system of controller (C) a user determination of the nature of the load to be delivered or loaded, that is, whether or not the load to be loaded is distillate (Block D). If the load to be loaded in the vessel is distillate, e.g., fuel oil, as mentioned, this information is further processed by the controller (C), in the manner shown in Block E. If the load to be loaded is not distillate, e.g., is gasoline, the information is processed by the controller (C) with an output of directions as shown in Block R. In Block or step E, a user determination of whether or not the previous load in the vessel was distillate is input into the controller (C). If the previous load was a distillate, the controller (C) will output directions as shown in Block V. If the previous load was not a distillate, or the enterer is not certain, the controller (C) will output directions as shown in Block R.

As those skilled in the art will recognize, the sequence of the entry of composition to be loaded and of the nature of previous composition is not critical. Accordingly, in the sequence shown in FIG. 2*a*, there is entered an input into the logic system of controller (C) a user determination of whether or not the previous load in the vessel was distillate (Block P). If the previous load was a distillate, there is further input into the logic system of controller (C) a determination of the nature of the load to be loaded, i.e., whether or not the load to be loaded is distillate (Block L). If the previous load was not a distillate, or the operator is not certain, the controller (C) will output directions as shown in Block R. If the load to be loaded in the vessel is distillate, this information is further processed by the controller (C) and outputted as shown in Block V. If the load to be loaded is not distillate, e.g., is gasoline, the information is processed by the controller (C) and outputted as shown in Block R.

In a typical operation, the operator of a vessel (1) to be loaded, such as tank truck, enters a loading terminal (T) of the type described and attaches vapor recovery line (5) to a vapor outlet (4) of the tank (1*a*) of the truck. A hose (3) from rack (6) is then attached to inlet (2), which is preferably at the bottom of tank 1*a*, and the truck is ready for loading. If the processor (C) has been input or provided the nature of the load to be delivered from the rack, such as by the rack or terminal operator, the vessel operator need input only the nature of the previous load at (I) if the load now to be loaded is a distillate. If so, the vessel operator accesses controller access (I) and inputs whether or not the previous load was distillate. Otherwise, the vessel operator inputs both the nature of the load to be loaded and the nature of the previous load. Inputs to the logic control system of the invention, as will be recognized by those skilled in the art, may also precede or be concurrent with the readying of the vessel for loading. The sequence of inputs to the logic system of the invention so far described follows that illustrated in FIG. (2). If the load to be loaded is a volatile organic chemical liquid, such as gasoline, controller (C) processes this entry and directs closure of valve 12 (or maintains closure of valve (12) if already closed) and opening of valve 11 (or maintains the open position of valve (11) if already open). A flow path is thus established or maintained from outlet (4) through hose (5), line (8), T-connection (9), and line **(8*a*) to the vapor control system (7). (Preferably, controller (C) will be programmed to revert the system to transfer captured vapor to the vapor control system after each loading to insure that accidental release of vapor to atmosphere does not occur.) System (7) may then be activated, if not already in operation, and loading of truck (1) may commence, volatile organic chemical vapors or vapor released during loading of the tank of the truck being captured and transferred to system (7) for processing. Regardless of the nature of the load previously present in the tank, vapors released during gasoline loading are sent to vapor control system (7)**.

If the load to be delivered is a distillate, however, such as #1 fuel oil, the invention requires processing of the determination of the nature of the previous load in the truck (FIG. 2, Block E). If the previous load was a volatile organic chemical liquid, such as gasoline, the entry or input is made that the previous load was not distillate, and processor (C) processes this entry and directs closure of valve (12) (or maintains closure of valve (12) and opening of valve (11) (or maintains the open position of valve (11), in the manner mentioned previously). The flow path is thus established from outlet (4) through hose (5), line (8), T-connection (9), and line **(8*a*) to the vapor control system (7), as previously described. Loading is commenced, and the vapor from truck (1) is processed by the vapor control system (7)**.

If, however, the input is entered that the previous load in the truck was distillate, controller (C) directs closure of valve (11) and opening of valve (12). Closure of valve (11) and opening of valve (12) creates an alternative flow path from line (5) through line (8), T-connection (9), line (10), valve (12), and vent line **(10*a* ). Upon commencement of loading of the tank 1*a* of truck (1) with distillate, the very minimal vapor released from outlet (4)** into the alternative flow path now provided may permissibly be vented or released to atmosphere.

An analogous operation is conducted in carrying out the logic outlined in FIG. **2*a* . More particularly, there is entered via controller access (I), and normally by the vessel operator as user, an input into the logic system of a determination of whether or not the previous load in the vessel was distillate (Block P). If the previous load was a distillate, there is further input into the logic system a determination of the nature of the load to be loaded, i.e., whether or not the load to be loaded is distillate (Block L). If the previous load was not a distillate, or the operator is not certain, the controller (C) will output directions as shown in Block R. In this case, controller (C) directs closure of valve (12) or maintenance of closure of valve 12, and opening of or maintenance of the open position of valve (11), as described previously, a flow path being established or maintained from outlet (4) through hose (5), line (8), T-connection (9), and line (8*a*) to the vapor control system (7). System (7) may then be activated, if not already in operation, and loading of truck (1) may commence, volatile organic chemical vapors released during loading of the tank of the truck being processed in the system (7). If the load to be loaded in the vessel is distillate, and the previous load was a distillate, this information is entered and processed by the controller (C) and outputted as shown in Block V. In this case, controller (C) directs closure of valve (11) and opening of valve (12). Closure of valve (11) and opening of valve (12) creates the alternative flow path from hose (5) through line (8), T-connection (9), line 10, valve (12), and vent line (10*a*). Upon commencement of loading of the tank of truck (1), the very minimal or virtually negligible vapors released from outlet (4)** into the alternate flow path now provided may permissibly be vented to atmosphere. If the load to be loaded is not distillate, e.g., is gasoline, the information is processed by the controller (C) and outputted as shown in Block R, i.e., the vapors are sent to the vapor control system.

While the invention has been illustrated with particular equipment, such as particular capture means, transfer means, and vent means, those skilled in the art will recognize that other equivalent apparatus or means may be employed.

What is claimed is:

1. A method of loading a vessel comprising providing a vapor control logic system which controls flow direction of vapor captured from a transporting vessel being loaded in response to user input or inputs;

inputting to the vapor control logic system a determination of the nature of an organic chemical liquid to be loaded, and, if a liquid of limited volatility, whether or not the previous load in the vessel was a liquid of limited volatility;

loading the vessel with the organic chemical liquid; and capturing vapor released from the vessel during loading and controlling the flow of vapor captured to a vapor control system or to vent.

2. The method of claim 1 in which a determination input to the vapor control logic system is that the liquid to be loaded is diesel fuel.

3. The method of claim 2 in which a determination input to the vapor control logic system is that the previous load was liquid of limited volatility, and in which the flow of vapor captured from the vessel is sent to vent.

4. The method of claim 1 in which a liquid of limited volatility is an organic chemical liquid composition having a true vapor pressure, at 60° F., of less than 1.5 pounds per square inch absolute.

5. A method of loading a vessel comprising providing a vapor control logic system which controls flow direction of vapor captured from a transporting vessel being loaded in response to user input or inputs;

inputting to the vapor control logic system a determination of whether or not the previous load in the vessel was a liquid of limited volatility; and, if so, the nature of an organic chemical liquid to be loaded;

loading the vessel with the organic chemical liquid; and capturing vapor released from the vessel during loading and controlling the flow of vapor captured to a vapor control system or to vent.

6. The method of claim 5 in which a determination input to the vapor control logic system is that the previous load was liquid of limited volatility.

7. The method of claim 6 in which a determination input to the vapor control logic system is that the liquid to be loaded is diesel fuel, and the flow of vapor captured from the vessel is sent to vent.

8. The method of claim 5 in which a liquid of limited volatility is organic chemical liquid composition having a true vapor pressure, at 60° F., of less than 1.5 pounds per square inch absolute.

9. A method of loading a vessel with an organic chemical liquid from a loading system including a vapor control system comprising providing a vapor control logic system which controls flow of vapor captured from a transporting vessel being loaded to a vapor control system or to vent;

inputting into said vapor control logic system the nature of the organic chemical liquid to be loaded and, if a liquid of limited volatility, whether or not the load previously carried by the vessel was a liquid of limited volatility;

processing the inputs in the vapor control logic system;

loading the vessel with the organic chemical liquid and capturing vapor released from the vessel during loading;

and controlling the flow of captured vapor in response to the inputs to the logic system, either to said vapor control system or to vent.

10. A method of loading a vessel with an organic chemical liquid from a loading system including a vapor control system comprising providing a vapor control logic system which controls flow of vapor captured from a transporting vessel being loaded to a vapor control system or to vent;

inputting into said vapor control logic system the nature of the organic chemical liquid to be loaded and, if a distillate, whether or not the load previously carried by the vessel was a distillate;

processing the inputs in the vapor control logic system;

loading the vessel with the organic chemical liquid and capturing vapor released from the vessel during loading;

and controlling the flow of captured vapor in response to the inputs to the logic system, either to said vapor control system or to vent.

11. The method of claim 10 in which, if an input to the logic system is that the organic chemical liquid to be loaded in the vessel is gasoline, the flow of captured vapor is directed to the vapor recovery system.

12. The method of claim 10 in which, if an input to the logic system is that the previous liquid loaded in the vessel was not a distillate, the flow of captured vapor is directed to the vapor control system.

13. The method of claim 10 in which, if the inputs to the logic system are that the organic chemical liquid to be loaded in the vessel is a distillate, and the previous load of the vessel was a distillate, the flow of captured vapor is vented to atmosphere.

14. The method of claim 13 in which an input to the logic system is that the liquid to be loaded is diesel fuel.

15. The method of claim 10 in which, if the inputs to the logic system are that the organic chemical liquid to be loaded is a distillate, but the previous liquid loaded in the vessel was not a distillate, the flow of captured vapor is directed to the vapor control system.

16. A method of loading a vessel with an organic chemical liquid from a loading system including a vapor control system comprising providing a vapor control logic system which controls flow of vapor captured from a transporting vessel being loaded to a vapor control system or to vent;

inputting to the vapor control logic system a determination of whether or not the previous load in the vessel was a distillate; and, if so, the nature of an organic chemical liquid to be loaded;

processing the inputs in the vapor control logic system;

loading the vessel with the organic chemical liquid and capturing vapor released from the vessel during loading;

and controlling the flow of captured vapor in response to the inputs to the logic system, either to said vapor control system or to vent.

17. A logic system for controlling vapor captured while loading a vessel comprising a) a user input for receiving a user determination input of the nature of an organic chemical liquid to be loaded in a vessel, and, if the liquid to be loaded is a liquid of limited volatility, a user determination input of whether or not the previous load in the vessel was a liquid of limited volatility;

b) a processor, coupled to said user input and responsive thereto, and configured to process one or both of said user determination inputs and output directions for control of vapor captured while loading said vessel.

18. A logic system for controlling vapor captured while loading a vessel comprising a user input for receiving a user determination input of whether or not the previous load in the vessel was a liquid of limited volatility, and, if the previous load was a liquid of limited volatility, a user determination input of the nature of an organic chemical liquid to be loaded in a vessel;

b) a processor, coupled to said user input and responsive thereto, and configured to process one or both of said user determination inputs and output directions for control of vapor captured while loading said vessel.

19. Apparatus for controlling vapor captured while loading a vessel comprising a) a user input for receiving a user determination input of the nature of an organic chemical liquid to be loaded in a vessel, and, if the liquid to be loaded is of limited volatility, a user determination input of whether or not the previous load in the vessel was a liquid of limited volatility;

b) a processor, coupled to said user input and responsive thereto, and configured to process one or both of said user determination inputs and output directions for control of vapor captured while loading said vessel;

c) means for capturing vapor released from said vessel;

d) means, communicating with said means for capturing vapor, and controlled by said processor, for transferring captured vapor to a vapor control system or to vent.

20. Apparatus for controlling vapor captured while loading a vessel comprising a) a user input for receiving a user determination input of whether or not the previous load in the vessel was a liquid of limited volatility, and, if the previous load was a liquid of limited volatility, a user determination input of the nature of an organic chemical liquid to be loaded in a vessel;

b) a processor, coupled to said user input and responsive thereto, and configured to process one or both of said user determination inputs and output directions for control of vapor captured while loading said vessel;

c) means for capturing vapor released from said vessel;

d) means, communicating with said means for capturing vapor, and controlled by said processor, for transferring captured vapor to a vapor recovery system or to vent.

21. A loading terminal comprising means for loading a liquid in a vessel;

a vapor control system for processing vapors released during loading of a vessel;

means for capture and selective transfer of vapor released during loading of said vessel to said vapor control system or to vent, said means for capture and selective transfer including programmed computer processing means for controlling flow of captured vapor in response to user determined input or inputs.

22. The terminal of claim 21 further comprising means for analyzing vapor captured by said means for capture of vapor, coupled to said computer processing means.

23. A loading terminal comprising means for loading a liquid in a vessel;

means for capture of vapor from a vessel being loaded;

means for transfer of vapor from said means for capture selectively to a vapor control system or to vent;

a vapor control system communicating with and adapted for receiving vapor from said means for transfer;

means for venting vapor, communicating with and adapted for receiving vapor from said means for transfer;

means for controlling flow of vapor in said means for transfer, including programmed computer processing means, to the vapor control system or to said means for venting in response to user determined input or inputs; and means for input of the nature of the load to be delivered to a vessel and the nature of the previous load in the vessel coupled to said means for controlling flow of vapor.

24. The terminal of claim 23 further comprising means for analyzing vapor captured by said means for capture of vapor, coupled to said computer processing means.

* * * * *